US005936551A

United States Patent [19]

Allen et al.

[11] Patent Number: 5,936,551

[45] Date of Patent: Aug. 10, 1999

[54] VEHICLE DETECTOR WITH IMPROVED REFERENCE TRACKING

[76] Inventors: Robert S. Allen, 70 Mule Deer Dr., Reno, Nev. 89523; Thomas R. Potter, Sr., 2260 Applewood Ct., Reno, Nev. 89509

[21] Appl. No.: 08/832,214

[22] Filed: Apr. 3, 1997

[51] Int. Cl.[6] ..... G08G 1/01

[52] U.S. Cl. ..... 340/941; 340/933; 340/939

[58] Field of Search ..... 340/425.5, 429, 340/430, 939, 941, 933; 377/9

[56] References Cited

U.S. PATENT DOCUMENTS

| | | | |
|---|---|---|---|
| 3,943,339 | 3/1976 | Koerner et al. | 235/92 TC |
| 3,989,932 | 11/1976 | Koerner | 235/92 FQ |
| 4,265,419 | 5/1981 | Scorteanu | 246/247 |
| 4,283,031 | 8/1981 | Finch | 246/128 |
| 4,296,401 | 10/1981 | Duley | 340/38 L |
| 4,472,706 | 9/1984 | Hodge et al. | 340/941 |
| 4,491,841 | 1/1985 | Clark | 340/939 |
| 4,568,937 | 2/1986 | Clark | 340/939 |
| 4,862,162 | 8/1989 | Duley | 340/939 |
| 4,945,356 | 7/1990 | Henderson et al. | 340/941 |
| 5,028,921 | 7/1991 | Potter | 340/939 |
| 5,153,525 | 10/1992 | Hoekman et al. | 324/655 |
| 5,247,297 | 9/1993 | Seabury et al. | 340/941 |
| 5,281,965 | 1/1994 | Hoekman et al. | 340/941 |
| 5,523,753 | 6/1996 | Fedde et al. | 340/933 |
| 5,652,577 | 7/1997 | Frasier | 340/933 |

*Primary Examiner*—Jeffery A. Hofsass
*Assistant Examiner*—Toan N. Pham
*Attorney, Agent, or Firm*—Warren P. Kujawa

[57] ABSTRACT

A vehicle detector with improved reference tracking routines in both the Call direction and the No Call direction. Call direction tracking includes rate sensitive tracking in which the reference is only changed in response to small fluctuations in loop frequency due to drift, and one or more fixed decrementing tracking intervals during which the reference is decremented at a fixed rate for a maximum predetermined period of time. Call direction tracking also includes infinite tracking during which the reference is decremented to an end value representative of loop inductance prior to the generation of a call signal. No Call tracking permits reference updating only after the loop frequency has stabilized for a minimum period of time, a minimum number of loop frequency samples or both.

33 Claims, 3 Drawing Sheets

VEHICLE DETECTOR WITH IMPROVED REFERENCE TRACKING

BACKGROUND OF THE INVENTION

This invention relates to vehicle detectors used to detect the presence or absence of a motor vehicle in an inductive loop embedded in a roadbed. More particularly, this invention relates to a vehicle detector with improved reference tracking.

Vehicle detectors have been used for a substantial period of time to generate information specifying the presence or absence of a vehicle at a particular location. Such detectors have been used at intersections, for example, to supply information used to control the operation of the traffic signal heads, and have also been used to supply control information used in conjunction with automatic entrance and exit gates in parking lots, garages and buildings. A widely used type of vehicle detector employs the principle of period shift measurement in order to determine the presence or absence of a vehicle in or adjacent the inductive loop mounted on or in a roadway. In such systems, a first oscillator, which typically operates in the range from about 10 to about 120 Khz is used to produce a periodic signal in a vehicle detector loop. A second oscillator operating at a much higher frequency is commonly used to generate a sample count signal over a fixed number of loop cycles. The relatively high frequency count signal is typically used to increment a counter, which stores a number corresponding to the sample count at the end of the fixed number of loop cycles. This sample count is compared with a reference count stored in another counter and representative of a previous count in order to determine whether a vehicle has entered or departed the region of the loop in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop remains unchanged, i.e., a vehicle has not entered or departed the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a vehicle in or near the loop. When these conditions exist, the vehicle detector generates a signal termed a Call Signal indicating the presence of a vehicle in the loop.

Correspondingly, if the difference between a sample count and the reference count is greater than a second threshold amount, this condition indicates that a vehicle which was formerly located in or near the loop has left the vicinity. When this condition occurs, a previously generated Call Signal is dropped.

Call Signals are used in a wide variety of applications, including vehicle counting along a roadway or through a parking entrance or exit, vehicle speed between preselected points along a roadway, vehicle presence at an intersection controlled by a traffic control light system, or in a parking stall, and numerous other applications. In all applications, it is necessary to periodically update the reference value so that the vehicle detector can be dynamically adjusted to varying conditions. For example, the loop wire, connecting cables and associated electronic analog circuitry are typically subject to widely varying temperature conditions, which cause the frequency of the loop signal to vary in a somewhat unpredictable manner. If the loop frequency drifts between sample periods by an amount equivalent to the period threshold count in the Call direction, a false call will be generated (since the sample count will be less than the reference count by the threshold value), even though no vehicle has actually entered the loop. This false call can be manifested by a green light in the lane controlled by the detector issuing the false call, even though no vehicle is actually present in that lane. This is clearly highly undesirable since it adversely affects vehicle flow through a controlled traffic system.

In the past, the problem of loop frequency drift has been addressed by a number of techniques. According to one known technique, the reference is slowly adjusted (typically once every two seconds) after taking the sample count by examining the difference between the sample count and the reference and (a) decrementing the reference count by one count when the sample count is less than the reference and (b) incrementing the reference count by one count whenever the sample count exceeds the reference. This technique suffers from several disadvantages. Firstly, while the slow tracking of the loop drift afforded by this approach from the No Call to Call direction is desirable, it is highly undesirable in the opposite direction (i.e., the Call to No Call direction). This is principally due to the fact that, starting with the Call condition, the reference is typically decremented to an artificially low value (typically 100 counts or more below the previous No Call reference value). If the vehicle which generated the call leaves the loop and another vehicle enters the loop, this new call condition will not be detected, since the new sample count will not be less than the current reference value until the reference is incremented by the testing threshold amount (which would take many cycles). As a result, the newly entered vehicle will not be serviced by the traffic control system (i.e., issuance of a green). In an attempt to avoid this disadvantage, a modification of this first technique has been developed which decrements the reference (typically once every two seconds) when the sample count is less than the reference value (the same as the decrementing in the first technique), but which changes the reference to the sample count whenever the sample count exceeds the current reference value. This technique introduces another disadvantage. Specifically, when a noise pulse is generated in the loop which causes the sample count to erroneously rise in value by a significant amount, which is a common occurrence, the new reference value is incorrectly set to an artificially high value. When the noise disappears (typically before the next sample count is taken), the new sample count drops back to the nominal No Call value, which causes a false call to be registered, with the observable disadvantages noted above. Further, since the reference is only decremented (typically once every two seconds), it may take a long period of time (possibly hours) for the reference to be readjusted to the nominal No Call value. During this period of adjustment, false calls are registered for each successive sample, and false greens are issued for the same period of time, which substantially disrupts the traffic control system.

Still further compounding this problem is the fact that an intermittent open loop can also disrupt the reference adjustment process by suddenly raising the loop inductance, which causes a corresponding increase in the sample count. For the case of a shorted loop, the reference value is gradually decremented to the extremely small value of the sample count registered by the shorted loop, during which time a false call will be registered. If the short self-corrects with a vehicle in the loop, the next sample count will exceed that of the invalid reference value and no call will be detected. The new reference will then be adjusted to the sample count obtained with the vehicle. However, since no call will be generated so long as the vehicle remains in the loop, the vehicle will never obtain a green signal, which is highly undesirable.

While other reference tracking routines have been implemented, a need still exists for a reliable tracking routine which minimizes or eliminates false call generation and which results in the reliable generation of valid calls in response to the arrival of a vehicle at the immediate proximity of the loop.

SUMMARY OF THE INVENTION

The invention comprises a vehicle detector method and system with improved reference count tracking in both the Call and No Call directions which minimizes the effects of non-vehicle related loop frequency fluctuations, thereby substantially reducing the incidence of false call signal generation and failure to generate valid call signals.

Two separate tracking routines are used in the invention: a first tracking routine in the Call direction, and a second tracking routine in the No Call direction.

The Call direction tracking routine includes two aspects: a Call not established routine and a Call established routine. The Call not established routine is entered whenever the difference between the sample count and the reference count lies in the Call direction (negative) and a Call has not been established. Under these conditions, the reference is updated by decrementing the reference value at a fixed rate by a fixed amount. The Call established routine is followed whenever a Call has been generated by the vehicle detector and the difference between the sample count and the reference count is less than the No Call threshold. Under these conditions, a plurality of separate and distinct sequential tracking intervals are used, with four intervals being used in the preferred embodiment. During the first tracking interval, a technique termed rate sensitive tracking is employed. Rate sensitive tracking proceeds as follows. A valid primary reference is first obtained and stored in memory. Successive sample counts are obtained at the end of each sample period and compared with the primary reference (by subtracting the reference from the sample count). After a valid call signal condition has been established (the value of the sample count minus the reference is $\leqq$ the call threshold), the current sample count is stored as a secondary reference. Thereafter, each successive sample count obtained at the end of each sample period is compared with the stored primary reference. If the difference between a sample count and the stored primary reference is greater than the No Call threshold (e.g. minus five counts or more positive), a No Call condition is established. When such a No Call condition is established, a No Call tracking routine is entered. So long as the No Call condition is not established, periodically (at the end of an interval termed the RST interval—which is substantially longer than the sample period), a current sample is compared with the stored secondary reference. If the absolute difference between the value of the current sample and the secondary reference exceeds a small threshold value (three counts in the preferred embodiment), the secondary reference is changed by substituting the current sample count for the previously stored sample count; the primary reference is not changed. However, if the difference in value between the current sample count and the secondary reference does not exceed the threshold, the primary reference count is updated by adding or subtracting the difference (depending on whether the difference is positive or negative). The secondary reference is also updated by replacing the old secondary reference with the current sample. At the end of the next RST interval, the then-current sample is compared with the secondary reference and the process is repeated. The rate sensitive tracking is performed so long as the Call condition exists for a predetermined fixed period of time (e.g., four minutes in the preferred embodiment). Thereafter, reference tracking is performed on a regular fixed basis. During the second tracking interval of the Call direction tracking routine, the reference is automatically decremented by a fixed amount for a predetermined period of time (e.g. one count every two seconds for four minutes). During the third tracking interval of the Call direction tracking routine, the reference count is decremented at a different fixed rate for another predetermined period of time (e.g. one count every four seconds for four minutes). Thereafter, the reference count is decremented at a different fixed rate for an open-ended period of time (e.g. one count every eight seconds until the No Call condition is established). In the preferred embodiment, the predetermined periods of time are fixed at four minutes.

For vehicle detectors having different sensitivity settings, the comparison intervals for rate sensitive tracking (the RST interval) and the fixed decrementing tracking intervals are selected in accordance with the vehicle detector sensitivity setting. In general, for relatively low sensitivity settings (i.e., those settings requiring a relatively large percentage change in loop inductance before a call condition is recognized), the RST interval and the fixed decrementing tracking intervals are relatively long. Conversely, for relatively high sensitivities (i.e., those requiring a relatively small change in loop inductance in order to recognize a call condition), the RST interval and the fixed decrementing tracking intervals are relatively short.

Whenever the difference between the sample count and the reference is equal to or greater than zero (i.e., is positive), the No Call direction tracking routine is entered. The next-occurring sample count is stored and a timing interval is initiated. The next sample is compared with the stored sample to determine the magnitude of the difference. If the difference exceeds a threshold value expressed as a percent of the value of the stored sample count, the previously stored sample is replaced by the newer sample, the timer is restarted and the subsequent sample is compared with the newly stored sample. If the difference between a subsequent sample and a stored sample count does not exceed the threshold difference, the timer is permitted to continue to count and a subsequent sample count is taken and compared with the originally stored sample count. During this process, the number of successful comparisons is accumulated. When the timer times out (indicating that each comparison in succession was within the permitted threshold), the number of comparisons made is examined. If this number exceeds a predetermined minimum value, the stored reference count is replaced by the most current sample count, and the process starts anew.

The effect of the No Call tracking routine is to permit relatively quick reference updating (measured by the period of the timer and the minimum number of samples) while preventing reference updating whenever the loop frequency undergoes rapid changes due to ambient conditions unrelated to vehicle presence or absence (such as noise or other transient conditions).

As a variation to the call direction reference tracking, an alternate routine is followed to provide infinite tracking, which is useful in applications requiring that the vehicle detector maintain a call signal for an indefinite period of time (e.g., when a vehicle is stalled at a parking gate). For infinite tracking, the first tracking interval comprises rate sensitive tracking or some other small change tracking routine. At the end of the first tracking interval, the value of the current sample count is obtained and an end value is computed. Thereafter, the reference is decremented at a fixed rate until this end value is reached. Thereafter, rate sensitive tracking or some other small change tracking routine is performed (so that the reference follows only small fluctuations in loop frequency) until a No Call condition is established.

The manner in which the end value is computed during the second interval of the infinite tracking routine can be performed in two different ways. In a first technique, the difference between the sample count and the previous reference at the end of the first tracking interval is scaled by a predetermined factor (e.g., one-half or 50%), and this scaled value is compared with a minimum threshold value representative of a fixed percent inductance change (e.g., 0.125% $\delta L$, where $\delta L$ is the change in inductance measured in sample counts due to an ordinary vehicle). If the scaled difference value is greater than the minimum threshold, then fixed decrementing of the primary reference is performed until the value of the reference reaches the scale factor value. For example, for a scale factor of one-half, the fixed decrementing of the primary reference continues until the value of the reference count equals one-half of the original difference at the start of the tracking interval.

The second technique is similar to the first but different in the manner in which the end value is computed. In the second technique, at the end of the first tracking interval, a count value is computed which represents a predetermined percentage of the current total loop inductance L (e.g. 0.25% L). This is done by multiplying the reference value (which is representative of the total loop inductance just prior to the establishment of the current Call condition) by the selected percentage value. Thereafter, the primary reference is decremented at a fixed rate by the amount of the count value, after which RST tracking is performed until the No Call condition is established.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
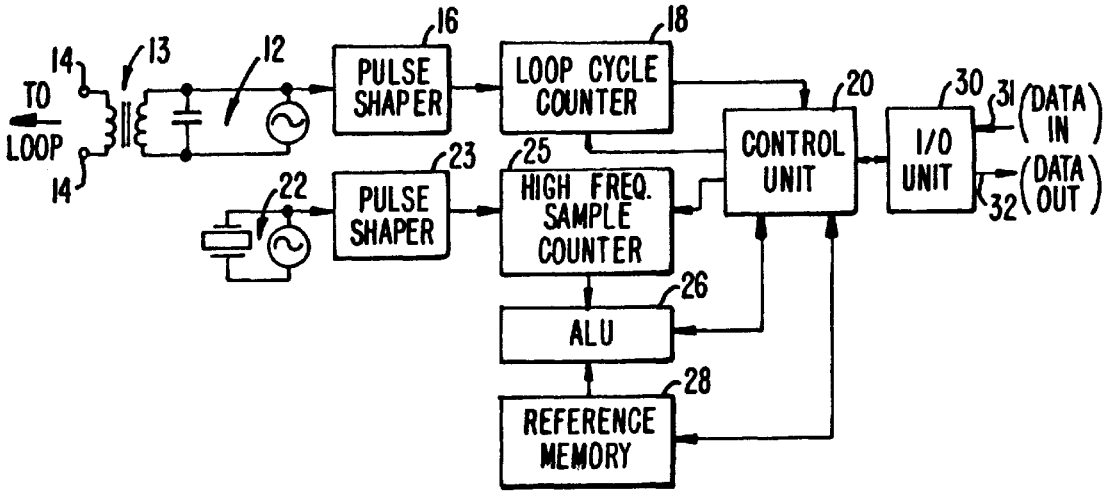
FIG. 1 is a block diagram illustrating a vehicle detector system incorporating the invention.

Turning now to the drawings, FIG. 1 is a block diagram of a vehicle detector incorporating the invention. As seen in this figure, an oscillator 12 operable over a frequency range of about 10 to about 120 Khz is coupled via a transformer 13 to a pair of output terminals 14. Output terminals 14 are adapted for connection to an inductive loop usually mounted within the roadbed in a position such that vehicles to be sensed will pass over the loop. Such loops are well-known and are normally found installed at controlled locations in the highway system, such as at intersections having signal heads controlled by a local intersection unit.

The oscillator circuit 12 is coupled via a squaring circuit 16 to a loop cycle counter 18. Loop cycle counter 18 typically comprises a multi-stage binary counter having a control input for receiving appropriate control signals from a control unit 20 and a status output terminal for providing appropriate status signals to the control unit 20, in the manner described below.

A second oscillator circuit 22, which typically generates a precise, crystal controlled, relatively high frequency clock signal (e.g., a 6 Mhz clock signal) is coupled via a second squaring circuit 23 to a second binary counter 25. Counter 25 is typically a multi-stage counter having a control input for receiving control signals from control unit 20 and a count state output for generating signals representative of the count state of counter 25 at any given time. The count state of counter 25 is coupled as one input to an arithmetic logic unit 26. The other input to arithmetic logic unit 26 is one or more reference values stored in a reference memory 28. Reference memory 28 is controlled by appropriate signals from control unit 20 in the manner described below.

An input/output unit 30 is coupled between the control unit 20 and externally associated circuitry. I/O unit 30 provides appropriate control signals via an upper input path 31 to specify the control parameters for the vehicle detector unit of FIG. 1, such as mode, sensitivity, and any special features desired. I/O unit 30 furnishes data output signals via lower path 32, the data output signals typically comprising signals indicating the arrival or departure of a vehicle from the vicinity of the associated loop.

Initially, control unit 20 supplies control signals to loop cycle counter 18 which define the length of a sample period for the high frequency counting circuit comprising elements 22, 23 and 25. For example, if control unit 20 specifies a sample period of six loop cycles, loop cycle counter 18 is set to a value of six and, when the sample period is to commence, control unit 20 permits loop cycle counter 18 to begin counting down from the value of six in response to the leading edge of each loop cycle signal furnished via shaping circuit 16 from loop oscillator circuit 12. Contemporaneously with the beginning of the countdown of the loop cycle counter 18, control unit 20 enables high frequency counter 25 to accumulate counts in response to the high frequency signals received from high frequency oscillator circuit 22 via second shaping circuit 23. At the end of the sample period (i.e., when the loop cycle counter has been counted down to zero), control unit 20 generates a disable signal for the high frequency counter 25 to freeze the value accumulated therein during the sample period. Thereafter, this sample count value is transferred to the ALU 26 and compared with the value stored in a reference memory 28, all under control of control unit 20. After the comparison has been made, the sample process is repeated.

The reference value in reference memory 28 is a value representative of the inductance of the loop oscillator circuit comprising elements 12–14 (and the associated loop) at some point in time. The reference is updated in the manner described below at the end of certain periods in response to certain comparisons involving the reference stored in memory 28 and successively obtained samples from counter 25. Whenever the difference between a given sample from counter 25 and the reference from memory 28 exceeds a first threshold value in the Call direction, the control unit 20 senses this condition and causes the generation of an output signal on path 32 indicating the arrival of a vehicle within the loop vicinity. Similarly, when the difference between a given sample and the previous reference exceeds a second threshold in the No Call direction the control unit 20 senses this condition and causes the call output signal on path 32 to be dropped. In the preferred embodiment, the Call direction is negative and the Call direction threshold value is −8 counts; while the No Call threshold value is −5 counts.

Figure 2:
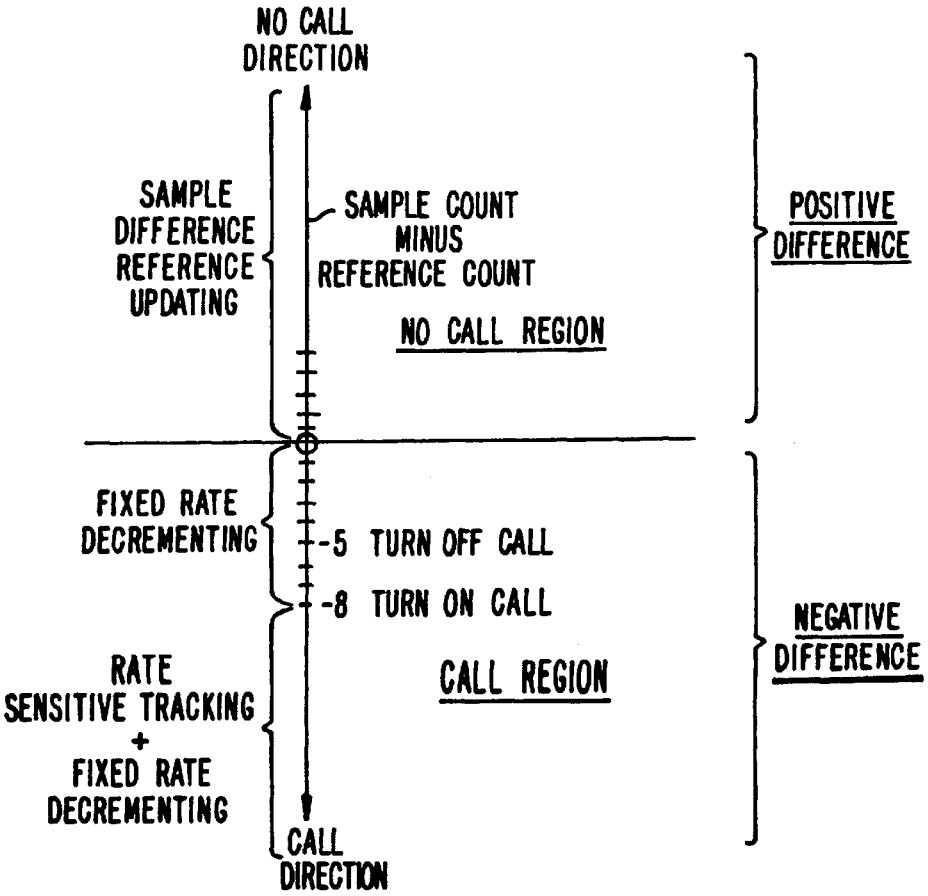
FIG. 2 is a schematic chart illustrating the Call-No Call thresholds and the regions in which the several tracking routines are employed.

FIG. 2 is a schematic plot illustrating the Call-No Call thresholds. The ordinate in FIG. 2 plots the difference between the sample count and the reference count (i.e., the signed value sample count-reference). In the negative region below the zero value, the turn on call threshold is indicated at value −8. In the negative region above the call threshold the turn off call threshold is indicated at value 5. Thus, to generate a Call the value of the sample count must be at least 8 counts smaller than the value of the reference. Similarly, to drop a previously generated call, the value of the sample count must be no more than 5 counts smaller than the value of the reference (i.e., −5, −4, −3, −2, −1, 0 or positive).

In order to prevent loop frequency variations due to noise and other conditions unrelated to true vehicle presence or absence from adversely affecting the operation of the vehicle detector and possibly resulting in the generation of false call signals or the blocking of the generation of a valid call signal, the reference count stored in memory 28 is updated in accordance with different tracking routines: some employed for sample count changes when a Call condition has been established and others employed for sample count changes when a No Call condition has been established. FIG. 2 illustrates the regions for these different tracking routines. In the Call region, two separate types of tracking are employed: fixed decrementing tracking alone when no Call has been established and the difference is less than the call threshold value (i.e., in the range from −1 to −7), and a combination of rate sensitive tracking and fixed decrementing tracking after a Call has been established by a difference equal to or greater than the Call threshold. In the No Call region, a single type of tracking—termed sample difference reference updating—is employed. The tracking routines for the Call direction are illustrated in FIG. 3, while the tracking routine for the No Call direction is illustrated in FIG. 4.

Figure 3:
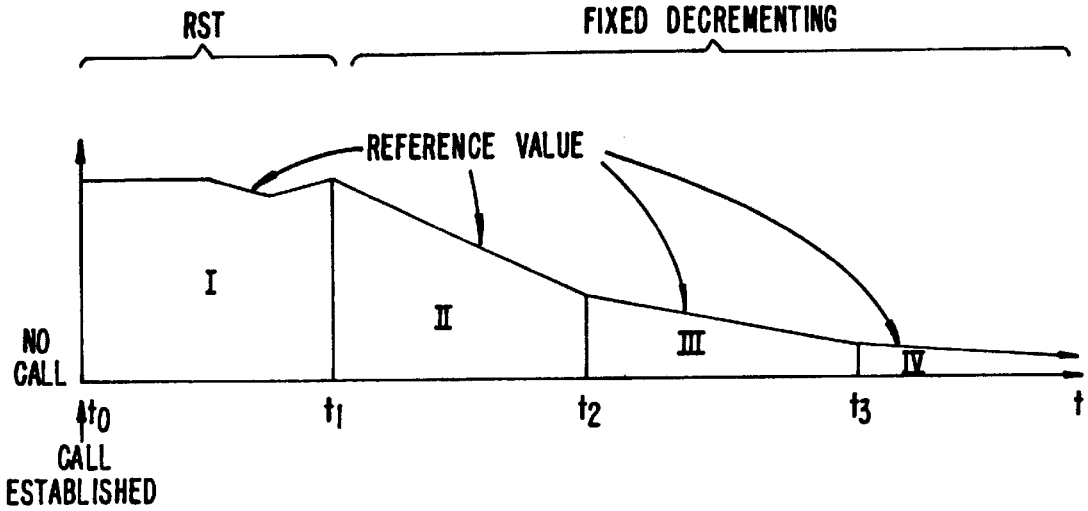
FIG. 3 is a tracking diagram illustrating reference tracking in the Call direction.
Figure 4:
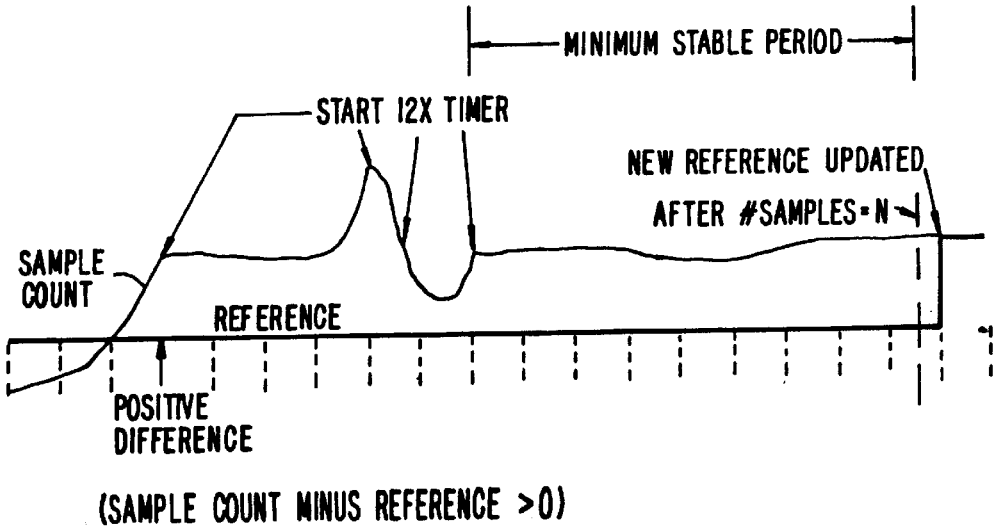
FIG. 4 is a tracking diagram illustrating reference tracking in the No Call direction.

With reference to FIG. 3, which is a plot of reference count versus time, there are two separate aspects to the Call direction tracking routines illustrated in this figure: the Call not established tracking and the Call established tracking. If the difference between the sample count and the reference is negative but less than the Call threshold (−8 counts) and no Call has yet been established, the reference is simply decremented at a fixed interval (e.g., every 250 milliseconds) by a fixed amount (e.g., one count). Once a Call has been established, the routines illustrated in FIG. 3 to the right of the point labelled "CALL ESTABLISHED" are employed. As seen in this FIG., there are four separate tracking intervals to the Call established tracking routine designated as intervals I–IV. During tracking Interval I, the reference count is only changed in response to small loop frequency fluctuations in accordance with a technique termed rate sensitive tracking. In the remaining three tracking intervals, II–IV, the reference count is changed in a pre-selected fixed manner at a rate which decreases from tracking interval to tracking interval. Rate sensitive tracking proceeds as follows.

With an initial valid reference stored in memory 28, successive sample counts are compared with the valid reference. When a vehicle enters the loop, a later sample count will be sufficiently smaller than the stored reference (which is the primary reference) that the difference (sample count minus reference) will be below the call threshold of minus 8 counts. This results in the generation of a valid Call signal on output path 32. The later sample count is placed in reference memory 28 as a secondary reference. Thereafter, each successive sample count obtained at the end of each sample period is compared with the value of the primary reference in memory 28. If the difference between these two values is greater than the No Call threshold (typically-five counts) a No Call condition is established. When such a No Call condition is established, the No Call tracking routine described below is entered.

So long as the No Call condition is not established, the rate sensitive tracking routine proceeds as follows. Periodically, at the end of an interval termed the RST interval (which is substantially longer than the sample period), a current sample count is compared with the stored secondary reference. If the absolute difference between the value of the current sample count and the secondary reference is greater than some small number (three counts in the preferred embodiment), the primary reference is not changed, but the secondary reference is changed by substituting the current sample count for the previously stored secondary reference count. If the difference in value between the current sample count and the secondary reference count is three or less, the value of the primary reference is changed by that amount by either subtracting the difference amount from the primary reference (if the difference is negative) or adding the difference amount to the reference (if the difference is positive). The secondary reference is also updated by replacing the old secondary reference with the current sample count. At the end of the next RST interval, the then-current sample count is compared with the secondary reference and the process is repeated. In between RST comparisons, successive sample counts are obtained at the end of each sample period and are compared with the primary reference in the manner described above. So long as the Call condition exists, and so long as the time interval defining tracking interval I has not elapsed, the primary reference and the secondary reference are processed in this manner. After the end of tracking interval I, which in the preferred embodiment is four minutes, the tracking routine changes to a fixed decrementing routine described below.

During tracking interval II of the call direction tracking routine, the reference is decremented by one count every M seconds, where M is an integer. During tracking interval III of the call direction tracking routine, the reference is decremented by one count every N seconds, where N>M. Similarly, during tracking interval IV of the call direction tracking routine, the reference is decremented by one count every P seconds, where P is an integer >N. In one embodiment of the invention having a fixed sampling period, M=two seconds, N=four seconds, and P=eight seconds. In addition, in the same embodiment the length of tracking intervals II and III is four minutes for each interval. The length of tracking interval IV is unbounded.

It should be noted that the length of the sample period (i.e., the time interval at the end of which a current sample count is obtained from counter 25) may be either fixed or may be settable in the case of a vehicle detector provided with multiple sensitivity settings.

In one embodiment in which vehicle detectors are provided with different selectable sensitivities, the length of the sample period and the length of the RST interval are both chosen in accordance with the sensitivity selected. In this embodiment, for a relatively low sensitivity setting (requiring a relatively large percentage change in loop inductance to establish a call condition), both the sample period and the RST interval are relatively long so that the reference count updating comparison is made at relatively long intervals; while for a high sensitivity setting (requiring a relatively small percentage change to establish a call condition), both the sample period and the RST interval are relatively short so that reference count comparison is conducted at relatively short intervals. Similarly, for the fixed decrementing portion of the tracking routine carried out during Call not established tracking and in tracking intervals II–IV during Call established tracking, the length of the decrementing interval decreases with increasing sensitivity. Representative values showing the sensitivity settings, sample time period, RST intervals, and fixed reference decrementing intervals for a specific implementation are shown in Table 1 below.

TABLE 1

| | | | Selected Sensitivity | | | |
|---|---|---|---|---|---|---|
| Sensitivity | Sample Period (ms) | RST Interval (seconds) | Interval II 4 minutes | Interval III 4 minutes | Interval IV infinite | No Call (seconds) |
| 1 | .40 | 128 | 128 | 256 | 512 | 32 |
| 2 | .80 | 64 | 64 | 128 | 256 | 16 |
| 3 | 1.6 | 32 | 32 | 64 | 128 | 8 |
| 4 | 3.3 | 16 | 16 | 32 | 64 | 4 |
| 5 | 6.6 | 8 | 8 | 16 | 32 | 2 |
| 6 | 13.3 | 4 | 4 | 8 | 16 | 1 |
| 7 | 26.6 | 2 | 2 | 4 | 8 | .5 |
| 8 | 53.3 | 1 | 1 | 2 | 4 | .25 |
| 9 | 106.6 | .5 | .5 | 1 | 2 | .125 |

The first column on the left of Table 1 is a listing of numerical sensitivity settings from a lowest sensitivity (1) to a highest sensitivity (9). The next column to the right sets forth the length of the sample time period in milliseconds. This is the time between successive samples. The next column to the right lists the value of the RST interval in seconds. The next column to the right lists the decrementing rates in seconds for tracking interval II and specifies the maximum length of the tracking interval (four minutes) The next column to the right lists the same information for tracking interval III. The next column to the right lists the same information for tracking interval IV (note that the maximum length of tracking interval IV is theoretically infinite). The right most column lists the fixed decrementing period when no call has been established but the difference between the reference and the sample count is negative (in the preferred embodiment, values ranging from −1 to −7). In this example, the total length of intervals I–III is the same: viz. four minutes for each interval, while Interval IV is theoretically infinite.

Taking sensitivity setting 6 as an example, the sample time is 13.3 milliseconds. The RST interval is four seconds: i.e., the reference count comparison is made once every four seconds. During tracking interval II, the reference is decremented by one count every four seconds; in tracking interval III, by one count every eight seconds; and in tracking interval IV, by one count every sixteen seconds. In the No Call condition (i.e., Call not established), the reference count is decremented by one count every second.

In some applications, it may be desirable to omit the rate sensitive tracking portion of the Call established tracking routine. In such applications, the tracking routing transitions directly from the No Call established fixed rate tracking to the tracking interval II fixed rate tracking. At the end of tracking interval II, the routine proceeds to the fixed rate decrementing (at different rates) of tracking intervals III and IV. In still other applications, it may be desirable to omit both the initial rate sensitive tracking interval I and one of the three fixed rate tracking intervals II–IV. In such applications, some combination of fixed rate tracking intervals must be selected (e.g., intervals II and III, intervals II and IV, or intervals III and IV) so that fixed decrementing of at least two different rates is performed on the reference. In addition, if desired, additional fixed rate tracking intervals with finite periods may be employed (e.g., by inserting one or more intervals between intervals I and II, intervals II and III, or intervals II and IV).

FIG. 4 is a tracking diagram illustrating the tracking routine for the reference count when the No Call condition is established. The No Call tracking routine commences when the difference between a sample count and a valid reference is positive, regardless of the magnitude of the difference (i.e., +1 count, +2 counts, +3 counts, etc.).

During No Call direction tracking the reference is preserved whenever the loop frequency changes in response to conditions unrelated to vehicle activity in or near the loop (i.e., noise or other transients). When such changes occur, the reference is preserved and is not updated until the loop has stabilized to a new frequency value in response to ambient changes. This stabilized state is deemed to exist whenever the absolute difference between successive sample counts lies below a threshold value for a minimum period of time and for a minimum number of successive samples. In addition, during reference updating in the No Call condition, the reference count is updated much more quickly than with the Call condition tracking routine (e.g., usually within a period of approximately 250 milliseconds).

FIG. 4 plots both the reference count and various sample count values as the ordinate versus time as the abscissa. Starting with a valid reference count in reference memory 28, once No Call direction tracking commences the next sample count is stored in a suitable memory location (i.e., a separate section of reference memory 28 or a separate memory unit) and a threshold value is computed from the stored sample count (e.g. 0.005 percent of the stored sample count value). In addition, a timer having a fixed pre-selected time out period (e.g., 250 milliseconds) is started. The next sample count is compared with the previously stored sample count. If the difference is greater than the threshold value, the timer is restarted and the previously stored sample count is replaced by the new sample count, and a new threshold value is computed. If the comparison indicates that the difference between the previously stored sample count and the present sample count is less than or equal to the threshold value, the previously stored sample count is not changed, the timer is permitted to continue running and the next sample count is compared with the previously stored sample count. If the successive difference values all lie below the threshold for the minimum comparison period measured by the timer, the reference count is updated by substituting the value of the most recent sample count for the reference in reference memory 28, provided that at least a predetermined number of successive samples have been taken. In the preferred embodiment, the minimum number of predetermined samples is 3. If the minimum number of samples has not been taken and compared with the stored sample count by the end of the minimum time period, the sampling and comparison process continues until this has occurred. For example, if the sample period is 106.6 milliseconds and the minimum time period is 250 milliseconds, the minimum time period will elapse before a total of three successive samples can be taken. In such a case, after the minimum time period has elapsed, the sample and comparison routine continues until three successful samples have been taken and compared.

It should be noted that consecutive sample counts need not be used in this tracking routine. If desired, every other sample count (i.e., sample counts 1, 3, 5, etc.), every third sample count (i.e., sample counts 1, 4, 7, etc.), or, in general, every ith count (where i is an integer) may be selected for comparison with the stored sample count for reference updating purposes. However, for Call condition comparison purposes (i.e., testing for a difference ≦ the call threshold), every consecutive sample is compared with the stored reference.

While a minimum time period of 250 milliseconds has been employed for the FIG. 4 tracking routine in the preferred embodiment of the invention, other periods may be selected. In general, the length of the minimum time period should not be so small that the reference will be updated in response to noise in the loop; or so large that the reference might never be updated when heavy vehicle traffic is present in the vicinity of the loop. The practical range today appears to be from about 100 milliseconds to about 2 seconds.

Further, in some applications of the invention the reference updating condition for the FIG. 4 tracking routine need not require both the lapsing of the minimum time period and the comparison of the minimum number of differences. In some applications it will be sufficient to rely upon only the minimum time period before permitting reference updating; in others just the minimum number of samples technique may be used. In all cases, however, the magnitude of the differences between successive samples must remain within the threshold boundary before permitting an update of the reference. Also, while a threshold boundary of 0.005 percent of the magnitude of the previously stored sample count has been chosen for the preferred embodiment, both larger and smaller values may be employed, depending upon the requirements of a given application. In general, large threshold boundary values will not screen out ambient noise as well as small values. Small values, however, require greater stability in loop frequency before permitting reference updating.

In addition, while the reference is updated in the FIG. 4 tracking routine by substituting the most recent sample count, other values may be employed as the new reference, e.g., the second most current sample count, the mean value of a preselected number of previous sample counts, the average value, etc. The desideratum is to provide a new reference value which reflects accurately the current loop frequency while filtering out noise and other short-term fluctuations unrelated to vehicle presence or absence.

During No Call condition tracking, the difference between the sample count and the reference is also monitored. If this difference becomes negative, the No Call condition tracking routine is stopped and the FIG. 3 tracking routine is entered.

While the Call direction tracking routine described above with reference to FIG. 3 is highly desirable in many vehicle detector applications, in other applications it is more desirable to provide a tracking routine once a call has been established which will maintain the Call condition so long as the vehicle remains on or near the loop. For example, in a parking entrance application in which an access gate is controlled by a vehicle detector to open when a car is present and to close when a car departs the vicinity of the loop, a vehicle may become immobilized (e.g., by an engine stall) while in or near the loop. If the tracking routine of FIG. 3 is followed, eventually the call signal will be tracked out by decrementing the reference to a value such that the sample count minus the reference equals the No Call threshold. In such a case, the call signal would be dropped and the gate would be actuated to the closed position. With the vehicle still present in the gate location, this can (and usually does) damage the vehicle.

Figure 5:
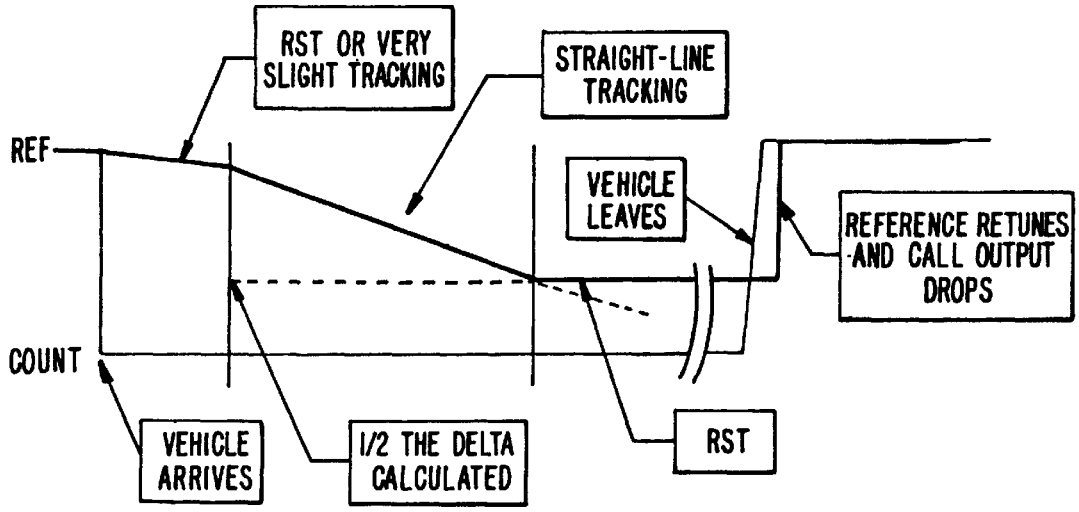
FIG. 5 is a tracking diagram illustrating a first embodiment of an infinite reference tracking routine.

In order to prevent this from occurring, the alternate tracking routine illustrated in FIG. 5 may be employed. As seen in this figure, in which the reference value is plotted as the ordinate versus time as the abscissa, once a call has been established, rate sensitive tracking of the type described above with reference to FIG. 2 (or some other small difference tracking at relatively long intervals) is followed during tracking Interval I. After the end of tracking Interval I, an infinite tracking routine is followed during tracking Intervals II and III, the purpose of which is to guarantee that the presence of the vehicle in the loop will never be tuned out so long as the vehicle detector remains operational. For the infinite tracking routine illustrated in FIG. 5, a first type of infinite tracking routine is followed: viz. tracking out a fixed percentage of the inductance change due to the presence of the vehicle in or near the loop. This routine proceeds as follows. At the beginning of tracking Interval II, the value of the sample count minus the reference is obtained and scaled by a predetermined factor. In the preferred embodiment, this factor is one-half: i.e., the difference is simply divided by two. This scaled difference is then compared with a minimum threshold difference representative of a percent inductance change. In the preferred embodiment, this threshold is 100 counts out of a sample of 160,000 counts which is equivalent to 0.125% $\delta L$, where $\delta L$ is the change in inductance measured in counts due to a regular vehicle (i.e., a standard sized automobile). If the scaled difference value is greater than the minimum threshold, the reference is decremented on a fixed rate basis (e.g., the fixed rate decrementing employed in tracking Intervals II or III of the FIG. 2 routine) until the value of the reference count reaches the scale factor value. For example, for a scale factor of one-half, the fixed decrementing of the reference continues until the value of the reference count is one-half of the original difference at the start of tracking Interval II. At this point, rate sensitive tracking or some other type of small difference tracking is applied to the reference so long as the vehicle remains in or near the loop. Once the vehicle departs, the No Call direction routine illustrated in FIG. 3 is entered.

If the value of the sample count minus the reference at the beginning of tracking Interval II is not greater than the minimum threshold, fixed decrementing tracking is applied to the reference in the manner already described above with reference to FIG. 2.

Figure 6:
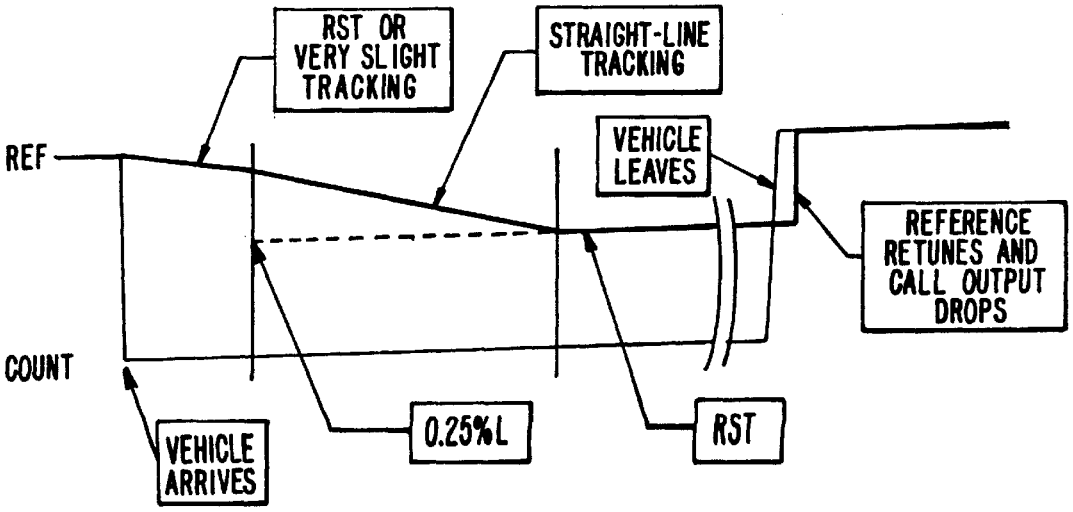
FIG. 6 is a tracking diagram illustrating a second embodiment of an infinite reference tracking routine.

FIG. 6 illustrates an alternate infinite tracking routine in which the reference is decremented by an amount which represents a fixed percentage of the total loop inductance at the beginning of the infinite tracking interval. As seen in this figure, tracking Interval I is the same as that for FIG. 5. At the beginning of tracking Interval II, a count value is computed which represents a predetermined percentage of the total loop inductance L at the beginning of tracking Interval II. In a preferred embodiment, this percentage is 0.25% L. The count value is computed by multiplying the reference, which is representative of total loop inductance L prior to the establishment of the Call condition, by the percentage. Thereafter, during tracking Interval II the reference is decremented at a fixed rate until the reference has been reduced by the computed count value. Thereafter, tracking Interval III is entered, which is the same as that described above with reference to FIG. 5.

While the infinite tracking routines described with reference to FIGS. 5 and 6 both include rate sensitive or small difference tracking intervals both before and after the interval during which the reference is decremented to an end value related to inductance, in some applications it may be desirable or sufficient to eliminate one or both of the rate sensitive or small difference tracking intervals. For example, the FIGS. 5 and 6 routines may be modified by eliminating interval I, interval III or both intervals I and III.

As noted above, infinite tracking is preferred in the type of parking gate application described. In general, infinite tracking is preferred whenever a vehicle detector loop is used in a system in which damage might occur if a call signal is dropped while the vehicle remains in the loop for a relatively long period of time, and the relatively long persistence of the Call condition will not adversely affect traffic flow. Thus, for example, the infinite tracking routines of FIGS. 5 and 6 should not be used in a controlled left turn lane vehicle detector installation: otherwise, a car stalled in a left turn lane will maintain the left green signal active for the maximum time period and will always reactivate this signal at the beginning of the next left turn cycle, even though the left turn lane is blocked by the stalled vehicle.

As will now be apparent, vehicle detectors provided with tracking routines in the Call and No Call directions as described above enable the reference to track loop frequency fluctuations caused by both vehicle and non-vehicle related sources while minimizing the risk of inadvertently dropping a call signal, failing to register a valid call signal or causing false call signals. In addition, the tracking routines can be implemented in microprocessor based vehicle detectors using reliable software routines at a relatively low cost. An ASCII hex listing of the software used for implementing the reference count tracking routines with the vehicle detector of FIG. 1 is attached as Appendix I. This listing is annotated to indicate those portions of the code pertaining to Call direction tracking and No Call direction tracking.

Although the invention may be implemented using a variety of hardware elements, the preferred embodiment employs the combination of a microprocessor and several discrete electronic components.

Although the above provides a full and complete disclosure of the preferred embodiments of the invention, various modifications, alternate constructions and equivalents will occur to those skilled in the art. For example, while specific time intervals and minimum sample numbers have been described, other values for these parameters may be selected, as desired. Further, while the invention has been described with reference to an implementation in which the reference is decremented toward a sample count in order to time out a call signal, other implementations may result in arithmetic logic in which the reference is incremented toward a sample count. Similar considerations apply to the No Call direction tracking routine and the infinite tracking routine. Therefore, the above should not be construed as limiting the invention, which is defined by the appended claims.

What is claimed is:

1. A method for updating a reference count in a vehicle detector having a loop subject to drift, the vehicle detector having a Call condition and a No Call condition, said method comprising the steps of:

(a) determining the establishment of a Call condition by comparing a sample count representative of loop inductance with a first reference;

(b) performing a first tracking routine to track out small changes in loop inductance for a first maximum time period so long as a Call condition exists by:

(i) generating a plurality of time-spaced sample counts;

(ii) comparing a later sample count with an earlier sample count;

(iii) changing the value of the first reference when the difference between the later sample count and the earlier sample count is less than a predetermined value; and (iv) repeating steps (ii) and (iii) at selected intervals for the first predetermined time period; and (c) performing a second tracking routine for a second maximum time period by changing the first reference count by a first predetermined amount at first preselected intervals.

2. The method of claim 1 wherein said step (ii) is performed by storing the earlier sample count as a second reference; obtaining the later sample count; and comparing the later sample count with the second reference.

3. The method of claim 2 wherein said step (ii) of comparing includes the step of storing the later sample count as a new second reference.

4. The method of claim 1 wherein the vehicle detector has a plurality of sensitivity settings; and wherein said selected intervals are dependent upon the vehicle detector sensitivity setting.

5. The method of claim 4 wherein said selected intervals are longer for relatively low sensitivity settings and shorter for relatively high sensitivity settings.

6. The method of claim 1 wherein the vehicle detector has a plurality of sensitivity settings; and wherein said first preselected intervals are dependent upon the vehicle detector sensitivity settings.

7. The method of claim 6 wherein said first preselected intervals are longer for relatively low sensitivity settings and shorter for relatively high sensitivity settings.

8. The method of claim 1 further including the step of performing a third tracking routine for a third maximum time period by decrementing the reference count by a second predetermined amount at second preselected intervals.

9. The method of claim 8 further including the step of performing a fourth tracking routine by decrementing the reference count by a preselected amount at third preselected intervals.

10. The method of claim 9 wherein said first, second and third maximum time periods are equal.

11. The method of claim 9 wherein said first and second predetermined amounts are equal.

12. The method of claim 1 wherein said step (b) of performing includes the step of performing a substitute tracking routine for the first tracking routine before a Call has been established by decrementing the reference count by a predetermined amount at preselected intervals.

13. A method for updating a reference count in a vehicle detector having a loop subject to drift, the vehicle detector having a No Call condition and a Call condition, said method comprising the steps of:

(a) determining the establishment of a No Call condition by comparing a sample count representative of loop frequency with a reference; and (b) when a No Call condition is established, updating the value of the reference when the loop frequency has varied by less than a predetermined amount for a preselected period of time by:

(i) storing a sample count;

(ii) initiating a timer for measuring said preselected period of time;

(iii) generating a subsequent sample count; and (iv) comparing the subsequent sample count with the stored sample count:

(A) if the difference between the subsequent sample count and the stored sample count is no greater than a threshold value, determining whether the timer has timed out;

(I) if so, setting the reference equal to the last sample count and returning to step (ii);

(II) if not, repeating steps (iii) and (iv);

(B) if the difference between the subsequent count and the stored sample count is greater than the threshold value, replacing the sample count with the subsequent count, reinitiating the timer, and repeating steps (iii) and (iv).

14. The method of claim 13 wherein said threshold value is a predetermined percentage of the stored sample count.

15. The method of claim 13 further including the steps of accumulating the number of successive sample count comparisons for which the difference is no greater than the threshold value, comparing the number with a minimum number, and performing step (I) only if the timer has timed out and the minimum number of successive sample count comparisons has been performed.

16. A method for updating a reference count in a vehicle detector having a loop subject to drift, the vehicle detector having a No Call condition and a Call condition, said method comprising the steps of:

(a) determining the establishment of a No Call condition by comparing a sample count representative of loop frequency with a reference; and (b) when a No Call condition is established, updating the value of the reference when the loop frequency has varied by less than a predetermined amount for a preselected number of successive sample counts by:

(i) storing a sample count;

(ii) generating a subsequent sample count;

(iii) accumulating the number of sample counts generated; and (iv) comparing the subsequent sample count with the stored sample count:

(A) if the difference between the subsequent sample count and the stored sample count is no greater than a threshold value, determining whether the predetermined number of sample counts has been accumulated;

(I) if so, setting the reference equal to the last sample count and returning to step (i);

(II) if not, repeating steps (ii) through (iv);

(B) if the difference between the subsequent sample count and the stored sample count is greater than the threshold value, replacing the stored sample count with the subsequent count, setting the accumulated sample count value to zero, and repeating steps (ii) through (iv).

17. The method of claim 16 wherein said threshold value is a predetermined percentage of the stored sample count.

18. The method of claim 16 further including the steps of establishing a preselected minimum period of time over which the loop frequency must vary by less than the predetermined amount, and performing step (I) only if the preselected period of time has elapsed and the minimum number of successive sample count comparisons has been performed.

19. A method for updating a reference count in a vehicle detector having a loop subject to drift, the vehicle detector having a Call condition and a No Call condition, said method comprising the steps of:

(a) determining the establishment of a Call condition by comparing a sample count representative of loop inductance with a reference;

(b) performing a first tracking routine for a first maximum time period so long as the Call condition exits by decrementing a reference count by a first predetermined amount at first preselected intervals; and (c) performing a second tracking routine for a second maximum time period so long as a Call condition exists by decrementing a reference count by a second predetermined amount at second preselected intervals.

20. The method of claim 19 wherein the vehicle detector has a plurality of sensitivity settings; and wherein said first and second preselected intervals are dependent upon the vehicle detector sensitivity settings.

21. The method of claim 20 wherein said preselected intervals are longer for relatively low sensitivity settings and shorter for relatively high sensitivity settings.

22. The method of claim 19 further including the step of performing a third tracking routine for a third maximum time period by decrementing the reference count by a third predetermined amount at third preselected intervals.

23. The method of claim 22 further including the step of performing a fourth tracking routine by decrementing the reference count by a preselected amount at fourth preselected intervals.

24. The method of claim 22 wherein said first, second, and third maximum time periods are all equal.

25. The method of claim 22 wherein said first, second, and third predetermined amounts are all equal.

26. The method of claim 19 wherein said second preselected intervals are longer than said first preselected intervals.

27. The method of claim 22 wherein said third preselected intervals are longer than said second preselected intervals.

28. A method of updating a reference count in a vehicle detector having a loop subject to drift, the vehicle detector having a Call condition and a No Call condition, said method comprising the steps of:

(a) determining the establishment of a Call condition by comparing a sample count representative of loop frequency with a reference; and (b) when a Call condition is established:

(i) performing a first tracking routine by establishing a reference end value related to current loop inductance and changing the reference at a fixed rate so long as the Call condition persists until the reference equals the reference end value.

29. The method of claim 28 wherein said step (i) of performing is followed by the step (ii) of performing a second tracking routine by changing the reference only when the loop frequency drifts by no more than a preselected relatively small amount until a No Call condition is established.

30. The method of claim 28 wherein said step of establishing a reference end value includes the steps of obtaining the difference between the sample count and the reference value, and selecting a predetermined percentage of the difference as the reference end value.

31. The method of claim 30 further including the steps of comparing the reference end value with a minimum threshold value, and performing a fixed rate tracking routine when the reference end value is less than the minimum threshold value.

32. The method of claim 28 wherein the step of establishing a reference end value includes the step of computing a predetermined percentage of the reference and subtracting the result from the reference to obtain the reference end value.

33. The method of claim 28 wherein said step (i) of performing is preceded by the step of performing a third tracking routine for a preselected maximum time period by changing the reference only when the loop frequency drifts by no more than a preselected relatively small amount.

* * * * *